United States Patent [19]

Steinberger et al.

[11] 4,380,451

[45] Apr. 19, 1983

[54] CONTINUOUS DYEING AND SIMULTANEOUS FINISHING OF TEXTILE MATERIALS USING DEFOAMING AGENT OF POLYOXYALKYLENE POLYSILOXANE COPOLYMER AND HYDROPHOBIC SILICA

[75] Inventors: Helmut Steinberger, Leverkusen; Wilfried Kortmann, Hagen; Jürgen Tuschen, Much, all of Fed. Rep. of Germany

[73] Assignee: Bayer Aktiengesellschaft, Leverkusen, Fed. Rep. of Germany

[21] Appl. No.: 305,660

[22] Filed: Sep. 24, 1981

[30] Foreign Application Priority Data

Oct. 15, 1980 [DE] Fed. Rep. of Germany ..... 3038984

[51] Int. Cl.[3] ..... D06P 1/61; D06M 13/00; B01D 19/04

[52] U.S. Cl. ..... 8/477; 8/581; 8/929; 252/8.9; 252/321

[58] Field of Search ..... 8/477, 581; 252/321, 252/8.9

[56] References Cited

U.S. PATENT DOCUMENTS

| | | | |
|---|---|---|---|
| 3,077,460 | 2/1963 | Fortess et al. | 524/837 |
| 3,168,543 | 2/1965 | Black et al. | 528/29 |
| 3,402,192 | 9/1968 | Haluska | 521/112 |
| 3,518,288 | 6/1970 | Haluska | 521/111 |
| 3,637,783 | 1/1972 | Haluska | 521/112 |
| 3,700,400 | 10/1972 | Cuthbertson | 8/477 |
| 3,746,653 | 7/1973 | Churchfield | 252/321 |
| 3,784,479 | 1/1974 | Keil | 252/358 |
| 3,865,544 | 2/1975 | Keil | 8/581 |
| 3,984,200 | 10/1976 | Doesburg | 8/581 |

FOREIGN PATENT DOCUMENTS

| | | |
|---|---|---|
| 9240 | 4/1980 | European Pat. Off. . |
| 36475 | 1/1981 | European Pat. Off. . |
| 2929588 | 2/1981 | Fed. Rep. of Germany . |
| 3004824 | 8/1981 | Fed. Rep. of Germany . |
| 1373903 | 11/1974 | United Kingdom . |
| 1583246 | 1/1981 | United Kingdom . |
| 1585874 | 3/1981 | United Kingdom . |

OTHER PUBLICATIONS

American Dyestuff Reporter, vol. 69, Jun. 6, 1980, New York, U.S.A., pp. 42–50, "Foam Control in Textile Systems" by David N. Willig.

*Primary Examiner*—A. Lionel Clingman
*Attorney, Agent, or Firm*—Sprung, Horn, Kramer & Woods

[57] ABSTRACT

A de-foaming agent comprising by weight about (a) 80 to 100 parts of a polyoxyalkylene-polysiloxane copolymer of the formula:

$$[R^1Si(OSiR_2)_n]_mZ_{m-1}(OR^2)_{m+2},$$

in which

R represents an optionally halogen-substituted alkyl-group with up to 4 carbon atoms, $R^1$ represents the substituent R or a phenyl radical, $R^2$ represents a group of the composition $$R^3(OCH_2CH_2)_xOCH_2\overset{CH_3}{\overset{|}{C}}H)_y-,$$

Z represents the difunctional unit —O— or $$\left[-O-\underset{R^4}{\overset{R^4}{C}}-\right]_pO-$$

and $R^3$ denotes a hydrocarbon radical with up to 6 carbon atoms, $R^4$ denotes independently from one another hydrogen or $R^3$, n denotes a number between 3 and 40, m denotes a number between 1 and 15, x denotes a number between 0 and 68, y denotes a number between 0 and 52, x+y denotes a number between 1 and 68 and p denotes a number between 2 and 12, and (b) 0.5 to 20 parts of a hydrophobic silicon dioxide.

4 Claims, No Drawings

CONTINUOUS DYEING AND SIMULTANEOUS FINISHING OF TEXTILE MATERIALS USING DEFOAMING AGENT OF POLYOXYALKYLENE POLYSILOXANE COPOLYMER AND HYDROPHOBIC SILICA

The invention relates to a process according to which textile materials, in particular pile material, consisting of natural or synthetic fiber materials or mixtures of such fibers with each other, can be dyed as well as finished in a continuous operation.

Finishing is to be understood as meaning the treatment of the textile materials, for example with antistatic agents, levelling agent, crease-resistant agent, hydrophobic and oleophobic agents, softeners, soil-release agent and/or flame-proofing agent.

A process has been disclosed in Textilveredlung 6(1971), No. 11, pages 708 to 711, according to which knitted textiles are dyed in a rotating drum, in a one-phase, aqueous foam of fine bubbles which is formed by means of specific anionic and non-ionic auxiliary agents, and which simultaneously contains dyestuffs, or other chemicals for fixing dyestuffs. This method has been developed with the intention of being able to dye the goods to be dyed in an extremely short liquor ratio, from which results a low energy and water requirement and a relatively low waste water contamination compared with other dyeing processes.

For this purpose, the liquid part of the total volume of the foam is kept as small as possible. After the foam has been distributed by means of centrifugal force in the dyeing drum at room temperature, the drum contents are heated with steam or hot air to the fixing temperature for the dyestuff, and the goods are treated for a certain time at this temperature, and then cooled and centrifuged.

This procedure involves a discontinuous process, which, owing to the drum, is not suitable for piece goods, but only for finished articles.

A further development of this process is described in DE-OS (German Published Specification) 2,402,353 and relates to the continuous application of a stable foam onto the textile goods to be dyed, the stable foam containing the necessary dyestuff as well as the auxiliary agents further required. The liquid content of the foam, together with the height of the foam layer applied, is used for regulating the quantity applied and therefore for adjusting the depth of shade.

After the foam has been deposited on the textile material, the textile goods are introduced into a steamer, in which the applied foam layer should disintegrate and the liquid present in the foam lamellae passes over onto the pile fibers or fabric fibers and wets these fibers, and in which the dyestuff acquires the temperature necessary for fixing on the fiber. For this purpose, the goods coated with the foam layer are usually fed through a channel containing a saturated steam atmospher (100° C.).

The foam formed is responsible for the simultaneous application and the fine distribution of the foamed liquor on the goods. When this has taken place, the foamed state of the liquor is no longer necessary and must be eliminated.

The destruction of the applied foam layer represents a particular problem of this dyeing process.

Either the spontaneous disintegration of foam of the applied foam layer based on the particular composition of a foam which is stable for a limited time, associated with an appropriately controlled goods velocity, or an initiated foam disintegration as a consequence of the addition of a foam-destroying agent (for example spraying a solution of a de-foaming agent or contact of the foam surface with a roller which is charged with a foam-destroying solution) have been mentioned as proposals for processes for the elimination of foam.

However, the processes mentioned for the destruction of the foam layer have disadvantages. In many cases, it is not possible to impart to the dyeing liquor, and thus to the foam prepared therefrom, a wetting capacity adequate for the particular textile goods, without the addition of the auxiliary agents suitable for this purpose. However, these auxiliary agents have, in many cases, a strong foam-stabilizing action, which makes impossible the creation of foams which are stable for a limited time.

The process whereby the foam disintegration is initiated by addition of foam-destroying agents (for example spraying) can be complicated by the fact that a rapid destruction of the foam is also effected at such places at which the foam carrying the dyestuff has not yet penetrated sufficiently deeply into the textile material. In this way, unevenness in the dyeing can result and, in certain circumstances, un-dyed places can remain.

The sufficiently deep penetration of the dye-foam, for example, in the pile is mostly achieved, in the case of higher pile goods, by leading the goods, after application of the foam layer, over a vacuum slit, which draws the applied foam just so far into the pile that after this operation a part of the foam is in the pile, without, however, being drawn through the base fabric. However, as a result of this measure, this portion of the foam is excluded from direct mixing with the applied foam-destroying agent. This can have the consequence either that the de-foaming within the pile does not occur rapidly enough and leads to severe expansion of the foam layer in the steaming operation, or that, due to the capillary adhesion of certain de-foamers, the liquor located between the fibers of the pile rapidly falls through to the base fabric. The result is that only the top of the pile and the foot of the pile are dyed.

For the same reasons as for the application of foam-destroying substances by spraying, bringing the foam layer into contact with a roller which has been provided with a foam-destroying agent can prove unsatisfactory.

The object of the present invention is now a process for the continuous dyeing and simultaneous finishing of textile materials in one operation, characterized in that a de-foaming agent, which is essentially composed of (a) 80 to 100 parts by weight of a polyoxyalkylenepolysiloxane copolymer of the general formula $$[R^1Si(OSiR_2)_n]_mZ_{m-1}(OR^2)_{m+2},$$

in which

R represents an optionally halogen-substituted alkyl group with up to 4 carbon atoms, $R^1$ represents the substituent R or a phenyl radical, $R^2$ represents a group of the composition $$R^3(OCH_2CH_2)_x(OCH_2\overset{\overset{CH_3}{|}}{C}H)_y-,$$

Z represents the difunctional unit —O— or

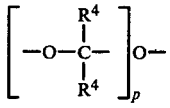

and $R^3$ denotes a hydrocarbon radical with up to 6 carbon atoms, $R^4$ denotes independently from one another hydrogen or $R^3$, n denotes a number between 3 and 40, m denotes a number between 1 and 15, x denotes a number between 0 and 68, y denotes a number between 0 and 52, x+y denotes a number between 1 and 68 and p denotes a number between 2 and 12, and (b) 0.5 to 20% by weight of a hydrophobic silicon dioxide, and simultaneously the finishing agent, is added to the dyeing liquor during the dyeing operation.

Surprisingly, it is possible with the process according to the invention to avoid the disadvantages described, and flaw-free dyeings and an excellent finish of the textile materials result.

The process according to the invention is carried out in a general embodiment as follows:

A pile material or a textile sheet-like structure passes through a foam-applying apparatus, which applies a foam of fine bubbles continuously in the prescribed thickness onto the upper side of the material to be dyed and simultaneously finished. The textile treated with foam is then led over a vacuum slit in such a way that a part of the foam applied onto the material is drawn into the pile, but is not drawn through the pile. Thereafter, the material thus prepared passes through an arrangement in which it is brought to a temperature of about 100° C. with the aid of saturated steam or warmed air, or by means of infra-red radiation. In this step, the disintegration of the foam is effected, with release of the interlamellar liquid bound in the foam, and this liquid completely wets the pile under the conditions provided and ensures the desired coloring of the pile material.

The liquor, from which the foam necessary for the process according to the invention is produced with the aid of stirring aggregates or blowing gas, consists, according to the invention, essentially of:

(a) the dyestuff or dyestuff mixture necessary for establishing the desired shade.

(b) one or several wetting agents of anionic, cationic or non-ionic nature (c) the de-foaming substance based on polyether-siloxane copolymers (d) a finishing agent and (e) further auxiliary agents which are necessary for optimizing the wetting behavior and/or the viscosity characteristics of the liquor.

The devices and machines required for the process according to the invention are in themselves known, as is also the principle of the technique (see, for example, Ch. Namboodri, R. Gregorijan, Continuous foam dyeing of carpets, Amer. Dyestuff Reporter, June 1978, pages 27–34).

The process for the preparation of the de-foaming agents used is characterized in that an organopolysiloxane of the general formula $$R^1Si(OSiR_2)_nU_{3-a-b}Cl_aW_b,$$

in which

U represents a radial of a low monobasic carboxylic acid with up to 4 carbon atoms, preferably an acetate radical, and W represents a radical of a fluorinated alkanesulphonic acid, a being equal to or less than 1 and b being equal to or less than 0.5, which is obtained by reaction of $R^1SiCl_3$ with a diorganopolysiloxane in the presence of a fluorinated alkanesulphonic acid or a salt thereof in excess monobasic carboxylic acid, is reacted with a mixture of $R^2$-OH and H-Z-H, the composition of which is determined by the chain length n of the organosiloxane member, in the presence of a base in an organic solvent, and is mixed, if appropriate, with 20 to 0.5% by weight of a hydrophobic silicon dioxide.

The use of the polyether-siloxane copolymers according to the invention allows the preparation of homogeneous dyestuff liquors and auxiliary agent liquors, and their foaming, without problems, to give foams which are stable and do not disintegrate up to temperatures of 50° C., and have the fineness of foam-bubbles which is necessary or desired for the process. The foaming of the defoaming substances allow, in addition, the addition of the agents necessary for the finishing.

A particular advantage of the process according to the invention is, als already mentioned, that the textile material can also be simultaneously finished in addition to the dyeing. The following agents, for example, are suitable for this purpose:

Antistatic agents based on polyglycols, fatty amines or phosphate esters

Levelling agents based on fatty alcohol-ethylene oxide condensates

Crease-resistant agents based on formaldehyde condensation products or methylol-melamine compounds Hydrophobic and oleophobic agents based on perfluoroalkylcarboxy resins, silicones Softeners fatty acid amides, fatty acid condensation products Soil-release agents based on polyacrylates Flame-proofing agents organic phosphorus compounds A particular problem with objects made from pile fabric, that is to say textiles, which have a certain surface structure from loops or cut-out loops (velour), is the maintenance of this surface structure during their useful life. It is a widespread experience that, for example, carpets made from pile fabric show damage from being walked on, from heavy objects lying on them, such as, for example, pieces of furniture, or from being driven on by wheelchairs, already after a relatively short time in use, and this damage is distinguished by a change in the surface condition.

Carpets subjected to treatment of this kind have pressure points, furrows and unevenly lying nap (so-called walking paths).

Pile-containing furniture-covering materials suffer the same kind of changes in their surface condition, preferably in the most easily accessible and the most heavily loaded places. The result is a non-uniform appearance of the textile surface.

To eliminate this condition, measures such as brushing, vacuuming or rubbing, and combinations thereof are carried out. These measures are, in many cases, troublesome, uneconomical and of little effect.

Processes have now been disclosed which achieve an excellent pile-stabilization and good soil-repelling effects with the aid of stable, aqueous methylsilsequioxane-silicic acid dispersions of particular particle size distribution. The processes for the preparation of such methylsilsesquioxane-silicic acid dispersions are characterized in that silanes of the general formula R-Si $(OR^+)_3$, wherein $R^+$ denotes a substituted or unsubstituted hydrocarbon radical with 1 to 7 carbon atoms, the substituents of which can be halogen atoms, amino groups, mercapto groups and epoxy groups, and up to 95% of the radicals $R^+$ denote a methyl radical and R denotes an alkyl radical with 1 to 4 carbon atoms, are added to a mixture of water, a buffer substance, a surface-active agent and, if appropriate, an organic solvent, with agitation and under acid or basic conditions.

By means of an even and slow addition to the aqueous solution of the silane quantity applied, the desired fine particle size distribution can be achieved, which produce an optimum pile-stabilizing action.

As is known, colloidal dispersions of this type represent systems which suffer damage to their stability and lose the useful properties mentioned, often just by limited external influences, such as salt additives, high mechanical action and addition of cationic, anionic or non-ionic surface-active agents.

It was therefore particularly surprising that certain adjustments of these methylsilsesquioxane dispersions are also still stable and effective for the purpose of use when they are mixed in preparations, the salt concentrations, surface-active agent concentrations and auxiliary agent concentrations of which would lead, according to experience, to the destruction of the colloidal dispersions.

Only this fact allows the use of a procedure in which methylsilsesquioxane-silicic acid dispersions can be added to a relatively concentrated solution of dyestuffs, surface-active agents and other auxiliary agents, and in which the dyeing as well as a pile-stabilizing and soil-repelling finishing can be carried out in a single operation.

Aliphatic and/or aromatic sulphonic acids, for example, decyl-, dodecyl-, cetyl-, stearyl-, myristyloleylsulphonic acids, or alkali metal salts thereof, are suitable anionic surface-active agents for the preparation of the pile-stabilizing agents. If cationic surface-active agents are used, it is advantageous to use halides and particularly chlorides and bromides. Other surface-active agents, including those of a non-ionic or amphoteric nature, can be used in combination with the abovementioned agents, provided the former do not have an adverse effect on the stability of the colloidal suspension, either because of their nature or their quantity.

A buffer which controls the pH value is of particular importance for the preparation of the pile-stabilizing agent. Only the addition of the buffer substance effects a controlled hydrolysis of such a form of the alkoxysilane, followed by condensation of the silanols formed therefrom, that the claimed pile-stabilizing effect comes into being.

The preparation of the colloidal suspensions can be carried out at temperatures between room temperature and 80° C.; particularly preferred is the temperature range between 50° and 70° C.

The process according to the invention is carried out with the following approximate concentrations of the agents employed:

De-foaming agent 0.2–1.8 g/l, preferably 0.5–1.0 g/l; surface-active agent (foam producer) 0.5–1.5 g/l; preferably 0.8–1.2 g/l; (wetting agent) 0.5–1.5 g/l, preferably 0.8–1.2 g/l; (re-forming agent) 0.5–1.5 g/l, preferably 0.8–1.2 g/l.

The total concentration of surface-active agents is thus approximately 1.5–4.5 g/l of liquor.

Between 0.1 and about 40 g/l of dyestuff and, if appropriate, urea in a concentration of 10 to 50 g/l are added to the dyeing liquor, according to type.

In other respects, the procedures are known in principle.

It is intended to illustrate the process according to the invention still more closely in the following text, with reference to the examples (if not otherwise indicated, % data refer to % by weight).

EXAMPLE 1

(Preparation example for a de-foaming agent according to the invention)

0.79 kg of methyltrichlorosilane (5.28 mols), 22.2 kg of octamethylcyclotetrasiloxane (75 mols) and 70 g of perfluorobutylsulphonic acid are initially introduced into a vessel and warmed to 60° C. 4.2 kg of acetic acid (70 mols) are added to the mixture at 60° C. in the course of one hour. After the addition of acetic acid has ended, the boiler content is heated up to a trough temperature of 125° to 130° C.

The mixture is then stirred for a further 5 hours at this temperature. Thereafter, the reaction mixture is cooled to under 50° C. and the pressure is carefully reduced to 50 mbars. The easily-boiling solvents contained in the reaction mixture are now expelled by heating up to a maximum trough temperature of 135° C. and a final vacuum of approximately 20 mbars.

Yield: approximately 22 kg of transparent product with a viscosity of approximately 50 mPas.

Acetate: 67.5 mVal/100 g

The product obtained according to the above description has been further reacted in the following manner:

15 kg of the acetoxysiloxane obtained are initially introduced into a boiler together with 15 kg of toluene. A mixture is prepared separately from 18.8 kg of a polyether started from butanol, with the molecular weight of 1,820, an ethylene oxide content of 15% and a propylene oxide content of 85%, the total ethylene oxide content contained being present as a block unit immediately following the starter molecule, and 25 kg of toluene, and is allowed to run into the mixture initially introduced, at room temperature in the course of approximately 15 minutes, while stirring strongly. 172 g of $NH_3$ are then introduced (325 l/h) during the course of 45 minutes. The mixture is now warmed to 80° C. When this temperature is reached, 90 g of isopropanol are added to the reaction mixture, and it is stirred for a further 3 hours at 80° C. and $NH_3$ is introduced during this time until the reaction mixture is saturated.

The product is cooled to room temperature, and the solution made cloudy by salt is filtered and the solvent is distilled off from the filtrate at 100° C. maximum and 20 mbars. A clear, slightly yellow-colored residue is obtained.

Preparation of the de-foaming agent 18.4 kg of the polyether-siloxane copolymer obtained according to the above instructions are stirred in a dissolver of commercially customary construction, at 400 rpm and are mixed with 0.6 kg of a hydrophobic, precipitated silicic acid with a BET surface of 130 $m^2/g$, at room temperature during the course of 1.5 hours. The mixture is transferred to a boiler which can be heated and evacuated, and is heated to 110° C. under a vacuum of 52 mbars during the course of 3 hours. A cloudy, viscous liquid is obtained.

EXAMPLE 2

(Use of the de-foaming agent according to the invention)

6 g of an acid dyestuff mixture of the type TELON-Licht are dissolved in one liter of water at 80° C., and 8 liters of cold water are added. 1.5 g of a mixture of 50% of an anionic Na-alkylbenzenesulphonate and 50% of a para-isononylphenol reacted with 7 mols of ethylene oxide are added to the solution. Furthermore, 1.5 g of the de-foaming agent according to the invention, of Example 1, are added to the mixture, and the mixture is processed with the aid of a dispersing device, which functions according to the principle of a rapidly rotating pin disc mill, under addition of air, to a foam which is capable of flowing, with a degree of foaming of 1 to 9. In this context, the degree of foaming is defined as the ratio of liquor to air. This foam is applied in a thickness of 10 mm to prewetted polyamide-carpet goods (velour, 600 $g/m^2$) by means of a foam-application device. The carpet goods coated with the foam are led over an open seam suction tube, the foam mat being sucked, without loss of weight, partly into the hap.

Immediately thereafter, the goods are led through a chamber charged with saturated steam (approximately 100° C.), and the foam disintegrates in the course of 15 seconds dwell time. To fix the dyestuff, the carpet goods remain for 3 minutes in the steaming apparatus and can then, if appropriate, be rinsed with water to remove the auxiliary agents.

The pile goods are evenly colored through up to the base fabric.

EXAMPLE 3

(Comparison of the foam stability of the foamed liquor after addition of de-foaming agent)

A dyestuff liquor, consisting of 0.53 g/l of acid dyestuff, 2.0 g/l of a 1:1 mixture of an anionic Na-alkylbenzenesulphonate and a para-isononylphenol, which has been reacted with 7 mols of ethylene oxide, and 1.5 g/l of de-foaming agent and 15 g/l of a pile-stabilizing finishing agent of Example 4 has been foamed, under addition of air, with the aid of a foaming apparatus in the foaming ratio of 1 to 9, and the wetting of the foam has been determined at room temperature in a sedimentation vessel, as a function of time. In each case, to determine the wetting, 1 l of foam has been used immediately after its preparation.

The following de-foaming agents have been compared:

I—De-foaming agent according to the invention, of Example 1

II—Commercially customary 30% strength de-foaming emulsion based on silicone

III—Commercially customary de-foaming agent based on polyether-siloxane copolymers IV—Organic, commercially customary de-foaming agent based on isooctyl alcohol

| De-foaming agent | Wetting of the foam after t seconds (ml) | | | | |
|---|---|---|---|---|---|
| | 10" | 20" | 60" | 120" | 300" |
| I | 0.0 | 0.0 | 0.1 | 0.5 | 2.2 |
| II | 100 | 100 | 100 | 100 | 100 |
| III | 70.0 | 100.0 | 100.0 | 100.0 | 100.0 |
| IV | 44.0 | 90.0 | 100.0 | 100.0 | 100.0 |

Remaining foam quantity, in percent of the foam volume employed, after t seconds.

EXAMPLE 4

(Preparation of the pile-stabilizing agent)

430 kg of water, 2.1 kg of sodium tetraborate and 0.4 kg of an anionic surface-active agent (for example Na-dodecylbenzenesulphonate) are initially introduced into a boiler of 500 l capacity, and warmed to 60° C., whilst stirring. 70 kg of methyl triethoxysilane and 8 kg of tetraethoxysilane are then added to the mixture in measured quantities in the course of 5 hours, the reaction temperature being maintained at 60° C. After subsequent metered addition has been completed, the mixture is further stirred for 3 hours at the same temperature and is then cooled to room temperature. The brine is ready for use after subsequent filtration through a hair sieve with an internal mesh diameter of 0.04 mm.

EXAMPLE 5

(Use example)

A dyestuff liquor, consisting of 0.53 g/l of an acid dyestuff mixture of the type TELON-Licht, 2.0 g/l of a 1:1 mixture of an anionic Na-alkylbenzenesulphonate and a para-isononylphenyl, which had been reacted with 7 mols of ethylene oxide, and, further, 2.0 g/l of a Na salt of a substituted fatty sulphonic acid ester, 1.5 g/l of the de-foaming agent according to the invention, of Example 1, and 15.0 g/l of a pile-stabilizing agent of Example 4 have been foamed, under addition of air, with the aid of a foaming apparatus in the foaming ratio of 1:9. In this context, the degree of foaming is defined as the ratio of liquor to air. This foam is applied in a thickness of 10 mm onto pre-wetted polyamide carpet goods (velour, 600 $g/m^2$) by means of a foam-application device. The carpet goods coated with the foam are lead over an open seam suction tube, the foam layer being sucked, without loss of weight, partly into the nap.

Immediately thereafter, the goods are led through a chamber charged with saturated steam (approximately 100° C.), and the foam disintegrates in the course of 15 seconds dwell time. To fix the dyestuff, the carpet goods remain for 3 minutes in the steaming apparatus, and are then rinsed with water to remove the auxiliary agents.

The pile goods are evenly colored through, up to the base fabric.

The carpet sample is dried for 5 minutes at 150° C., uniformly shorn, and the back covered with a layer of a commercially customary latex sheet foam.

In each case, the same samples have been taken from this material, according to the DIN (German Industrial Standards) Specifications.

For comparison, samples have likewise been taken from a material of the same type which, except for the addition of the pile-stabilizing agent, had been identically pre-treated.

The samples are first soiled with, in each case, 10 g of a synthetic soil of the following composition.

1,932 g of schamotte
40 g of iron oxide, black
20 g of iron oxide, yellow
8 g of soot
1,000 g of water The loading of the samples is effected according to the roll-mill test, which is fully described in the DIN (German Industrial Standard) Specification 54 324, with a roll load of 60 kg in total and a change in the direction of rotation of the rolls after every 50 revolutions.

The assessment is effected visually. The condition of the pile in comparison to goods which have not been loaded is assessed.

| Sample | (A) immediately | (b) after 1 hour | (c) after 3 hours |
|---|---|---|---|
| with pile-stabilizer | 1 | 3 | 4 |
| without pile-stabilizer | 1 | 1 | 2 |

(Scale: 1 = very strong change; 5 = no change)

Soiling of the samples: the assessment of the samples is effected visually. The assessment is carried out by 6 different judges. Evaluation is carried out in comparison to a sample which has not been treated. (Scale: 1=very strong change, 5=no change)

| Sample | Soiling |
|---|---|
| with | 4 |
| without pile-stabilizer | 1 |

It will be understood that the specification and examples are illustrative but not limitative of the present invention and that other embodiments within the spirit and scope of the invention will suggest themselves to those skilled in the art.

We claim:

1. A de-foaming agent comprising by weight about (a) 80 to 100 parts of a polyoxyalkylenepolysiloxane copolymer of the formula:

$$[R^1Si(OSiR_2)_n]_mZ_{m-1}(OR^2)_{m+2},$$

in which

R represents an optionally halogen-substituted alkyl group with up to 4 carbon atoms, $R^1$ represents the substituent R or a phenyl radical, $R^2$ represents a group of the composition $$R^3(OCH_2CH_2)_x(OCH_2\overset{\overset{\displaystyle CH_3}{|}}{C}H)_y-,$$

Z represents the difunctional unit —O— or $$\left[-O-\underset{\underset{\displaystyle R^4}{|}}{\overset{\overset{\displaystyle R^4}{|}}{C}}-\right]_p O-$$

and $R^3$ denotes a hydrocarbon radical with up to 6 carbon atoms;

$R^4$ denotes independently from one another hydrogen or $R^3$, n denotes a number between 3 and 40, m denotes a number between 1 and 15, x denotes a number between 0 and 68, y denotes a number between 0 and 52, x+y denotes a number between 1 and 68 and p denotes a number between 2 and 12, and (b) 0.5 to 20 parts of a hydrophobic silicon dioxide.

2. In the continuous dyeing of a textile material wherein a foam containing the dyestuff is applied to the textile material, the improvement which comprises simultaneously applying a finishing agent for the textile material and a defoaming agent according to claim 1, whereby the material is simultaneously dyed and finished in one operation.

3. A process according to claim 2, wherein the finishing agent comprises a dispersion of methylsilsesquioxane and silicic acid.

4. A process according to claim 2, wherein the textile material is a pile fabric.

* * * * *